US012410604B2

(12) United States Patent
Williams Richards

(10) Patent No.: US 12,410,604 B2
(45) Date of Patent: Sep. 9, 2025

(54) STRUCTURAL FUSES CONFIGURED TO YIELD IN TENSION AND COMPRESSION AND STRUCTURES INCLUDING THE SAME

(71) Applicant: Durafuse Frames, LLC, West Jordan, UT (US)

(72) Inventor: Paul Williams Richards, Orem, UT (US)

(73) Assignee: Durafuse Frames, LLC, West Jordan, UT (US)

( * ) Notice: Subject to any disclaimer, the term of this patent is extended or adjusted under 35 U.S.C. 154(b) by 235 days.

(21) Appl. No.: 18/060,703

(22) Filed: Dec. 1, 2022

(65) Prior Publication Data

US 2023/0175248 A1 Jun. 8, 2023

Related U.S. Application Data

(60) Provisional application No. 63/287,308, filed on Dec. 8, 2021.

(51) Int. Cl.
*E04B 1/24* (2006.01)

(52) U.S. Cl.
CPC .... *E04B 1/2403* (2013.01); *E04B 2001/2415* (2013.01); *E04B 2001/2442* (2013.01)

(58) Field of Classification Search
CPC ..... E04B 1/2403; E04B 2001/2415; E04B 2001/2442; E04B 2001/2457; E04H 9/024
USPC ..... 52/167.1
See application file for complete search history.

(56) References Cited

U.S. PATENT DOCUMENTS 263,426 A * 8/1882 O'Brien ..... B60R 13/0206 52/651.1
1,727,293 A * 9/1929 Larkin ..... E04B 1/2403 403/173
1,744,600 A * 1/1930 Wilcox ..... E04B 1/2403 403/230
2,106,084 A * 1/1938 Coddington ..... E04C 3/08 52/655.1
2,114,901 A * 4/1938 Henderson ..... E04B 1/944 52/837
2,114,902 A * 4/1938 Henderson ..... E04B 1/2403 52/838
3,106,270 A * 10/1963 Lichty ..... E04B 1/2403 52/301
3,716,957 A * 2/1973 Bernardi ..... E04B 1/5812 52/837

(Continued)

FOREIGN PATENT DOCUMENTS

KR 101344813 B1 * 12/2013
KR 101406485 B1 * 7/2014
KR 20140105643 A * 9/2014

OTHER PUBLICATIONS

U.S. Appl. No. 63/287,308, filed Dec. 8, 2021.

*Primary Examiner* — James M Ference
(74) *Attorney, Agent, or Firm* — Ballard Spahr LLP

(57) ABSTRACT

Embodiments are directed to structural fuses, structures including the same, and methods of using and forming the same. In an embodiment, a structural fuse is disclosed. The structural fuse includes a first attachment region defining one or more first bolt holes, a second attachment region defining one or more second bolt holes, and a yielding region between the first attachment region and the second attachment region. The yielding region defines one or more slots exhibiting an elongated shape.

21 Claims, 8 Drawing Sheets

(56) References Cited

U.S. PATENT DOCUMENTS 4,014,089 A * 3/1977 Sato ..... E04B 1/2403 228/140
5,148,642 A * 9/1992 Plumier ..... E04H 9/0237 52/638
5,595,040 A * 1/1997 Chen ..... E04H 9/02 52/837
5,660,017 A * 8/1997 Houghton ..... E04H 9/024 52/283
6,012,256 A * 1/2000 Aschheim ..... E04C 3/086 52/573.1
6,059,482 A * 5/2000 Beauvoir ..... F16B 9/058 403/187
6,138,427 A * 10/2000 Houghton ..... E04B 1/2403 52/655.1
6,516,583 B1 * 2/2003 Houghton ..... E04B 1/24 52/638
7,497,054 B2 * 3/2009 Takeuchi ..... E04B 1/2403 403/403
7,712,266 B2 * 5/2010 Sarkisian ..... E04H 9/0237 52/573.1
8,615,948 B2 * 12/2013 Underkofler ..... E04B 9/067 52/506.07
8,800,239 B2 * 8/2014 Yang ..... E04B 1/2403 403/403
8,875,452 B2 * 11/2014 Kawai ..... F16F 7/12 52/167.1
10,316,507 B2 * 6/2019 Richards ..... E04H 9/024
10,544,577 B2 * 1/2020 McManus ..... H01H 85/08
10,584,477 B2 * 3/2020 Richards ..... E04B 1/98
10,669,718 B2 * 6/2020 Pryor ..... E04B 1/2403
10,689,876 B2 * 6/2020 Richards ..... E04H 9/024
10,760,261 B2 * 9/2020 Richards ..... E04C 3/06
11,072,938 B2 * 7/2021 Pryor ..... E04H 9/024
11,162,260 B2 * 11/2021 Pryor ..... E04H 9/024
11,299,880 B2 * 4/2022 Pryor ..... E04B 1/24
2002/0184836 A1 * 12/2002 Takeuchi ..... E04C 3/04 52/289
2004/0050013 A1 * 3/2004 Okada ..... E04C 3/32 52/848
2004/0187430 A1 * 9/2004 Takeuchi ..... E04B 5/10 52/837
2004/0237456 A1 * 12/2004 Simmons ..... E04C 3/04 52/837
2005/0055970 A1 * 3/2005 Simmons ..... E04B 1/2403 52/837
2006/0144006 A1 * 7/2006 Suzuki ..... E04H 9/024 52/655.1
2006/0265992 A1 * 11/2006 Hiragaki ..... E04B 5/43 52/633
2009/0223146 A1 * 9/2009 Platt ..... E04B 9/10 52/745.2
2009/0223166 A1 * 9/2009 Ohata ..... E04B 1/2403 52/699
2010/0205876 A1 * 8/2010 Christopoulus ..... E04H 9/024 52/698
2011/0030305 A1 * 2/2011 Karns ..... E04B 1/2403 52/655.1
2013/0074427 A1 * 3/2013 Kawai ..... E04H 9/0237 188/371
2014/0182234 A1 * 7/2014 Yang ..... E04B 1/2403 52/655.1
2014/0325932 A1 * 11/2014 Tran ..... E04C 3/06 52/700
2015/0159362 A1 * 6/2015 Pryor ..... E04B 1/1903 52/655.1
2015/0159369 A1 * 6/2015 Chen ..... E04B 1/2403 52/167.8
2015/0275501 A1 * 10/2015 Houghton ..... E04H 9/024 52/854
2017/0218616 A1 * 8/2017 Richards ..... E04H 9/024
2018/0274223 A1 * 9/2018 Richards ..... E04C 3/06
2018/0347222 A1 * 12/2018 Richards ..... E04H 9/021
2019/0186165 A1 * 6/2019 Pall ..... E04B 1/92
2019/0249410 A1 * 8/2019 Richards ..... E04H 9/024
2019/0292783 A1 * 9/2019 Pryor ..... E04C 3/38
2020/0011051 A1 * 1/2020 Hou ..... E04G 23/02
2020/0362585 A1 * 11/2020 Hou ..... E04H 9/021
2022/0316202 A1 * 10/2022 Richards ..... E04H 9/024
2022/0333369 A1 * 10/2022 Richards ..... E04B 1/2403
2022/0333397 A1 * 10/2022 Richards ..... E04B 1/2403
2023/0058224 A1 * 2/2023 Evans ..... E04B 1/2608
2023/0175248 A1 * 6/2023 Richards ..... E04B 1/2403 52/167.1

* cited by examiner

STRUCTURAL FUSES CONFIGURED TO YIELD IN TENSION AND COMPRESSION AND STRUCTURES INCLUDING THE SAME

CROSS-REFERENCE TO RELATED APPLICATION(S)

This application claims priority to U.S. Provisional Patent Application No. 63/287,308 filed on Dec. 8, 2021, the disclosure of which is incorporated herein, in its entirety, by this reference.

BACKGROUND

When designing structures to resist severe earthquake or wind loads, engineers may rely on ductility to prevent catastrophic failure. Engineers may design certain parts of the building to yield in a controlled manner in order to accommodate the large movements associated with severe earthquakes and wind loads. The parts of the structure that are typically designed to yield in a controlled manner are beams, braces, walls, and/or columns.

SUMMARY

Embodiments are directed to structural fuses, structures including the same, and methods of using and forming the same. In an embodiment, a structural fuse is disclosed. The structural fuse includes a first attachment region defining one or more first bolt holes, a second attachment region defining one or more second bolt holes, and a yielding region between the first attachment region and the second attachment region. The yielding region defines one or more slots exhibiting an elongated shape. The yielding region is configured to be slidably attached to a structural element via the one or more slots.

In an embodiment, a structure is disclosed. The structure includes a first structural element, a second structural element spaced from the first structural element by a gap, and at least one structural fuse attaching the first structural element to the second structural element. The structural fuse includes a first attachment region attached to the first structural element, a second attachment region attached to the second structural element, and a yielding region between the first attachment region and the second attachment region. The yielding region slidably attached to the second structural element.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1A:
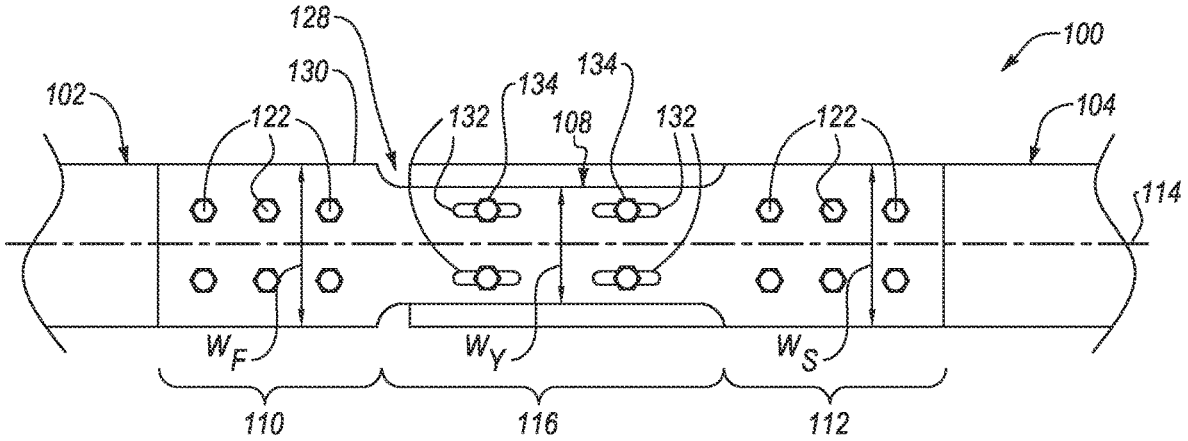
FIGS. 1A and 1B are a bottom plan view and a side elevational view of a structure, according to an embodiment.

Embodiments are directed to structural fuses, structures including the same, and methods of using and forming the same. An example structural fuse includes a first attachment region configured to be attached to a first structural element, a second attachment region configured to be attached to a second structural element, and a yielding region extending between the first and second attachment regions. The yielding region is configured to be slidably attached to the second structural element.

The structural fuse may form part of a structure. The structure includes a first structural element and a second structural element. The first and second structural elements may include a column, a beam, a link beam, a coupling beam, a brace, a wall, a floor, or foundation. The first and second attachment regions of the structural fuse may be rigidly attached (e.g., using bolts, rivets, welds, nails, etc.) to the first and second structural elements, respectively. The yielding region may be slidably attached to the second structural element. During loading (e.g., caused by earthquakes or wind), the portions of the first and second structural elements may move closer together or further apart. The movement of the first and second structural elements causes the first and second attachment regions of the structural fuse to likewise move due to the rigid attachments between the first and second structural elements and the first and second attachment regions, respectively, of the structural fuse. The attachment between the yielding region and the second structural element allows the yielding region to move relative to the first and second structural elements. The movement of the first and second attachment regions of the structural fuse caused by the movement of the first and second structural elements may cause a tensile or compressive stress to be applied to the yielding region of the structural fuse which may cause the yielding region to yield. The yielding region of the structural fuse may want to buckle when a sufficiently large compressive stress is applied thereto. However, the slidable connection between the yielding region of the structural fuse and the second structural element may mitigate or restrain buckling of the yielding region of the structural fuse thereby preventing the undesirable drop in strength in the structural fuse caused by such buckling.

The structural fuses disclosed herein exhibit one or more improvements over conventional yielding elements (i.e., elements in conventional structures that are designed to yield in a controlled manner to accommodate movements caused by earthquakes and wind loads). In an example, the conventional yielding elements includes a structural element, such as a column, beam, a link beam, a brace (e.g., a buckling-restrained brace), a wall, a floor, or foundation. In such an example, yielding the structural requires replacement of the entire structural element. Replacing the entire yielded structural element may be costly and difficult. In some instances, replacing the entire yielded structural element may be impossible due to cost or due to weakening the structure. Meanwhile, the structural fuses disclosed herein are configured to yield before the structural elements to which the structural fuses are attached. It is significantly easier and simpler to replace the structural fuse than the structural element. In an example, the conventional yielding elements may include a Simpson yield link. The Simpson yield link includes a Simpson structural fuse which is different from the structural fuses disclosed herein, an additional plate covering an exterior of the Simpson structural fuse, and one or more fillers that are configured to be attached to structural elements. The Simpson yield link is more complex to attach to the structural elements than the structural fuses disclosed herein due to the inclusion of the additional plate and the one or more fillers. The increased complexity of the Simpson yield link increases the likelihood that the Simpson yield link is incorrectly installed and increases the time required to install the Simpson yield link compared to the structural fuses disclosed herein.

Figure 1B:
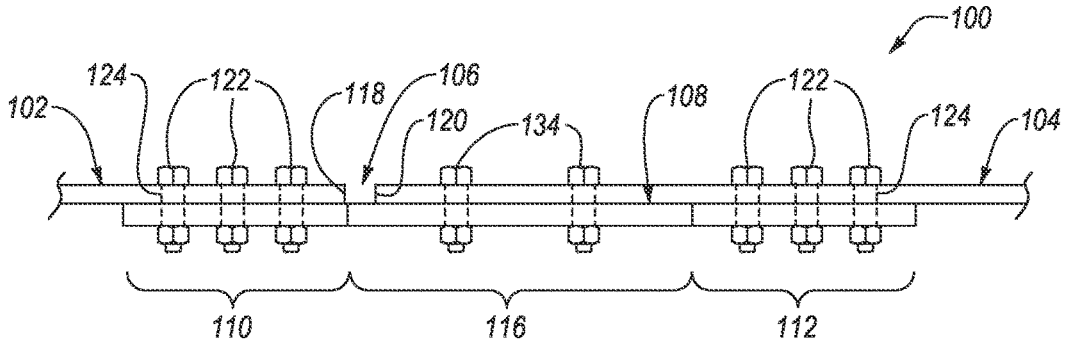

FIGS. 1A and 1B are a bottom plan view and a side elevational view of a structure 100, according to an embodiment. The structure 100 includes a first structural element 102 and a second structural element 104. The first and second structural elements 102, 104 are spaced from each other by a gap 106. The structure 100 also has a structural fuse 108 that is attached to the first and second structural elements 102, 104. The structural fuse 108 is configure to attach the first and second structural elements 102, 104 together. The structural fuse 108 is also configured to preferentially yield when the first and second structural elements 102, 104 move relative to each other thereby preventing or at least inhibiting yielding of the first and second structural elements 102, 104. Yielding the structural fuse 108 instead of the first and second structural elements 102, 104 may make repair of the structure 100 significantly easier. The structural fuse 108 is also configured to prevent or at least inhibit buckling thereof when the structural fuse 108 yields due to a compressive load.

Figure 7A:
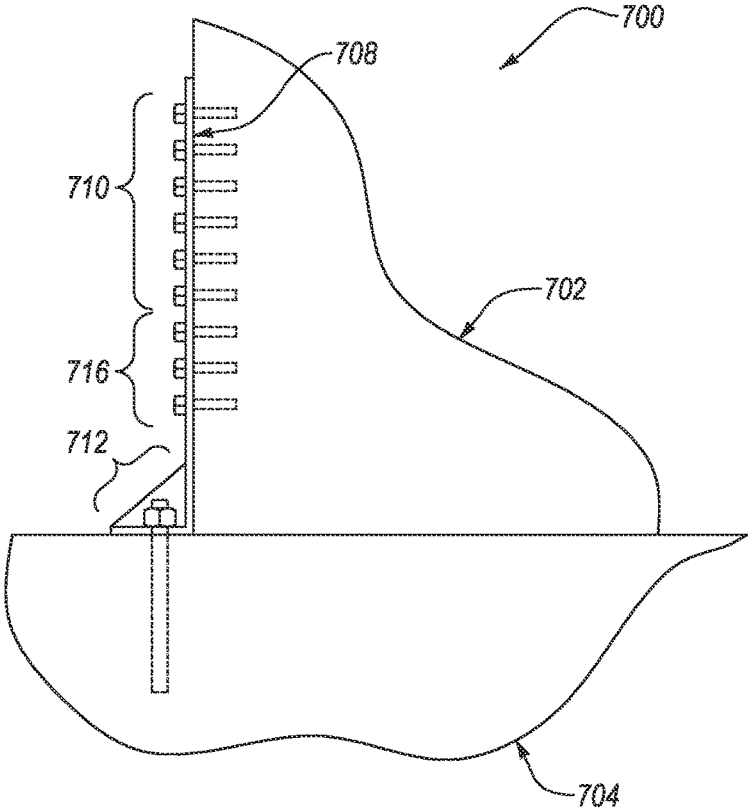
FIGS. 7A and 7B are a side elevational and front elevational view of a structure, according to an embodiment.

The first and second structural elements 102, 104 may include any elements that may form part of the structure 100. In an example, as illustrated, the first and second structural elements 102, 104 may be plates. In an example, the first and second structural elements 102, 104 may include an I-beam, a hollow structural section (e.g., a square, rectangular, or circular hollow structural section), or other structural element. In an example, the first and second structural elements 102, 104 may be aligned generally parallel (as shown) or perpendicular (as shown in FIG. 7A) to each other. In an example, the first and second structural elements 102, 104 may be a column, a beam, a link beam, a coupling beam, a brace, a wall, a floor, a foundation, or any other structural element.

Figure 4A:
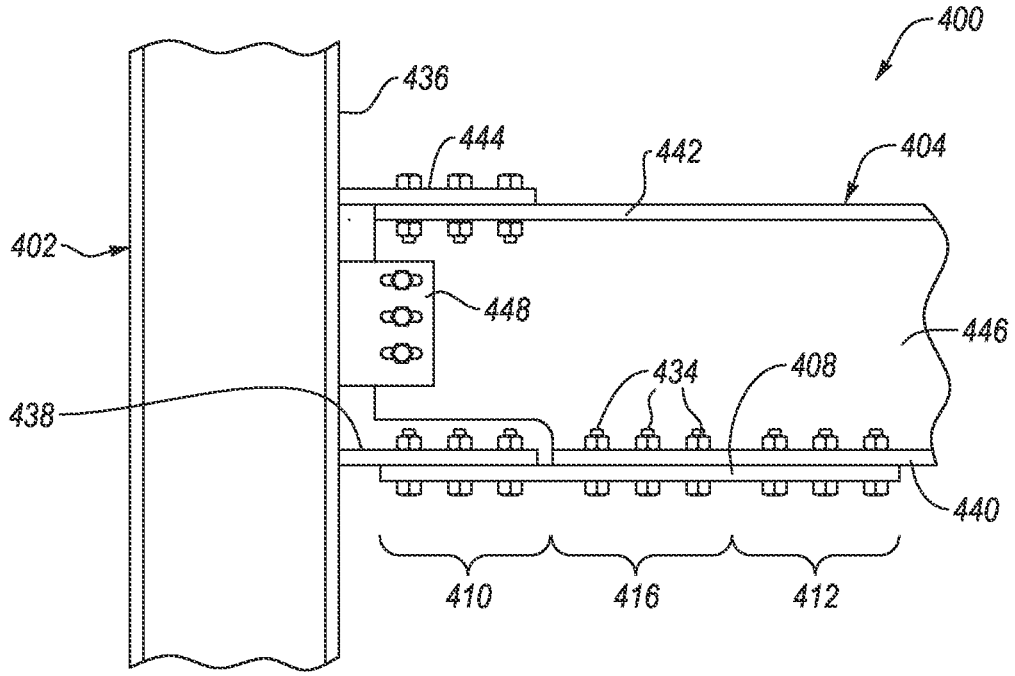
FIGS. 4A-4C are side elevational, bottom plan, and top plan views, respectively, of a structure, according to an embodiment.
Figure 4B:
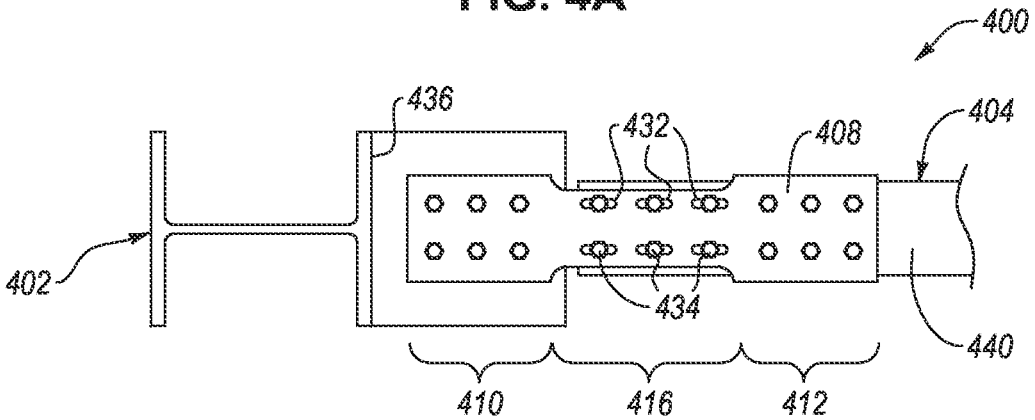

The structural fuse 108 includes a first attachment region 110 and a second attachment region 112. The first and second attachment regions 110, 112 are spaced from each other, for example, along a longitudinal axis 114 of the structural fuse 108. For example, the first and second attachment regions 110, 112 may be spaced from each other by a yielding region 116. The first attachment region 110 is configured to be attached, either directly (as shown) or indirectly (as shown in FIG. 4B) to the first structural element 102. For example, the first attachment region 110 is attached to a portion of the first structural element 102 that is adjacent or proximate to a terminal end 118 of the first structural element 102. The second attachment region 112 is configured to be attached, either directly (as shown) or indirectly, to a portion of the second structural element 104 that is adjacent to, proximate to, or spaced from a terminal end 120 of the second structural element 104. It is noted that the first attachment region 110 and/or the second attachment region 112 may be attached to a portion of the first structural element 102 or the second structural element 104, respectively, that is spaced from the terminal end of the structural element, as shown in FIG. 4A.

The first and second attachment regions 110, 112 may be rigidly (i.e., non-movably) attached to the first and second structural elements 102, 104 using any suitable technique. In an embodiment, as illustrated, the first and second attachment regions 110, 112 may be rigidly attached to the first and second structural elements 102, 104 using one or more bolts 122 (as shown) or one or more rivets. In such an embodiment, the first structural element 102, the second structural element 104, the first attachment region 110, and second attachment region 112 may define one or more bolt holes 124 (shown using dashed lines in FIG. 1B). The bolt holes 124 of the first structural element 102 and the bolt holes 124 of the first attachment region 110 may be aligned with each other and the bolt holes 124 of the second structural element 104 and the bolt holes 124 of the second attachment region 112 may be aligned with each other. The bolt holes 124 of the first structural element 102, the second structural element 104, the first attachment region 110, and the second attachment region 112 may be aligned in one or more rows that are generally parallel to the longitudinal axis 114 of the structure 100. For example, as illustrated, the bolt holes 124 may be aligned in two rows which, for example, may allow each row of bolt holes 124 to extend through a flange with an intersecting web therebetween when the first and second structural elements 102, 104 are I-beams. However, it is noted that the bolt holes 124 may be arranged in a single row or three or more rows.

In an embodiment, at least one of the first structural element 102 and the first attachment region 110 or the second structural element 104 and the second attachment region 112 may be attached together using a technique other than or in addition to the one or more bolts 122 or one or more rivets. For example, at least one of the first structural element 102 and the first attachment region 110 or the second structural element 104 and the second attachment region 112 may be attached together using a weld, clamps, straps, or any other suitable technique.

Figure 4C:
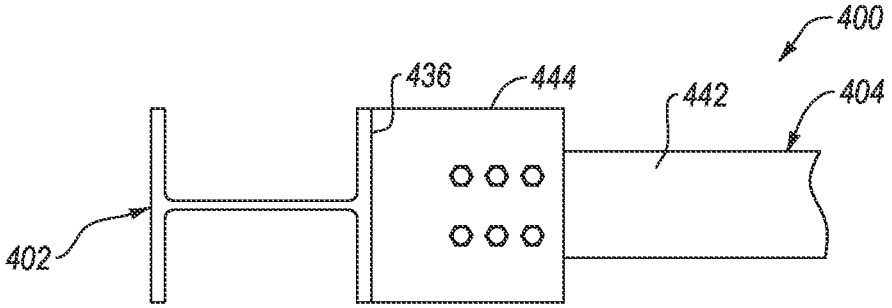
Figure 8A:
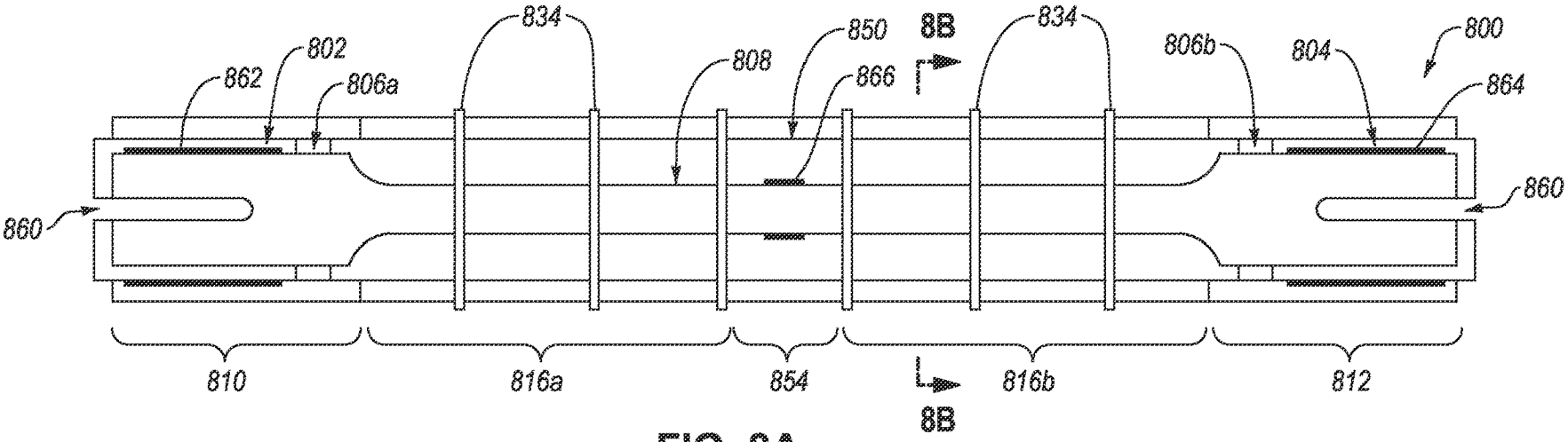
FIG. 8A is a side elevational view of a structure, according to an embodiment.
Figure 8B:
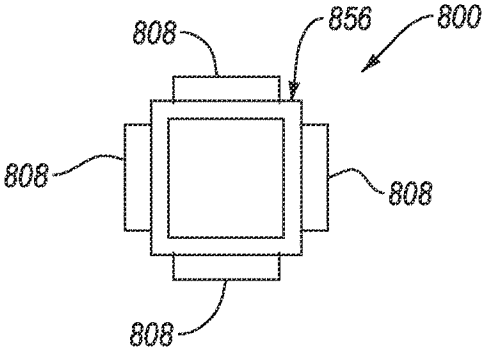
FIG. 8B is a cross-sectional view of the structure taken along plane 8B-8B.

The structural fuse 108 is configured to form a gap 106 between the first and second structural elements 102, 104 when the first and second attachment regions 110, 112 are attached to the first and second structural elements 102, 104, respectively, and substantially no external load (e.g., caused by earthquakes or wind loads) is applied to the structure 100. The gap 106 allows the first and second structural elements 102, 104 to move closer to each other without contacting each other when a compressive load is applied to the structural fuse 108. Without the gap 106, the first and second structural elements 102, 104 may need to deform to accommodate the compressive load instead of or in addition to yielding the structural fuse 108. The gap 106 may be selected to be about 0.5 cm to about 1 cm, about 0.75 cm to about 1.25 cm, about 1 cm to about 1.5 cm, about 1.25 cm to about 1.75 cm, about 1.5 cm to about 2 cm, about 1.75 cm to about 2.25 cm, about 2 cm to about 2.5 cm, about 2.25 cm to about 2.75 cm, about 2.5 cm to about 3 cm, about 2.75 cm to about 3.25 cm, about 3 cm to about 3.5 cm, about 3.25 cm to about 3.75 cm, about 3.5 cm to about 4 cm, about 3.75 cm to about 4.5 cm, about 4 cm to about 5 cm, about 4.5 cm to about 5.5 cm, about 5 cm to about 6 cm, about 5.5 cm to about 6.5 cm, about 6 cm to about 7 cm, about 6.5 cm to about 8 cm, about 7 cm to about 9 cm, about 8 cm to about 10 cm, about 9 cm to about 11 cm, about 10 cm to about 12 cm, about 11 cm to about 13 cm, about 12 cm to about 14 cm, or about 13 cm to about 15 cm. The gap 106 may be selected based on the amount of deformation that the structure 100 is configured to accommodate during severe loading. The amount of deformation that the structure 100 is configured to accommodate during severe loading may vary based on the type of structure. In an example, a structure that includes a beam-to-column connection (as shown in FIGS. 4A-4C) may include a gap of about 0.5 cm to about 5 cm or about 1.5 cm to about 3.5 cm. In an example, a structure that is a brace (as shown in FIGS. 8A and 8B) may include a gap that is greater than 3 cm, such as about 6 cm to about 10 cm.

The structural fuse 108 includes a yielding region 116 positioned between the first attachment region 110 and the second attachment region 112. The yielding region 116 is configured to preferentially yield when a sufficiently large load is applied to the structure 100. In particular, the yielding region 116 is configured to yield before the first structural element 102, the second structural element 104, the first attachment region 110, and the second attachment region 112 yields thereby preventing the need to repair a yielded first or second structural element 102, 104 and preventing weakening of the attachment between the first and second structural elements 102, 104 and the structural fuse 108.

The yielding region 116 of the structural fuse 108 may include one or more weakening features that are configured to weaken the yielding region 116 thereby causing the yielding region 116 to preferentially yield before the first structural element 102, the second structural element 104, the first attachment region 110, and the second attachment region 112 yields. In an embodiment, as illustrated in FIG. 1B, the weakening features of the yielding region 116 includes one or more cutouts 128 formed in the yielding region 116. In an example, the cutouts 128 extend inwardly from an outermost peripheral edge 130 of the structural fuse 108. The cutouts 128 cause the yielding region 116 to exhibit a width $W_Y$ that is less than the width $W_F$ of the first attachment region 110 and less than the width $W_S$ of the second attachment region 112, wherein the widths $W_Y$, $W_F$, and $W_S$ are measured perpendicular to the longitudinal axis 114 of the structural fuse 108. Assuming the thickness of the structural fuse 108 is substantially constant (e.g., the structural fuse 108 is formed from a plate), the smaller width $W_Y$ causes the yielding region 116 to exhibit larger stresses than first and second attachment regions 110, 112 thereby causing the yielding region 116 to preferentially yield.

In an example, the cutouts 128 may be configured to cause the width $W_Y$ of the yielding region 116 to be smaller than at least one of the width $W_F$ of the first attachment region 110 or the width $W_S$ of the second attachment region 112 by about 0.25 cm or more, about 0.5 cm or more, about 0.75 cm or more, about 1 cm or more, about 1.25 cm or more, about 1.5 cm or more, about 2 cm or more about 2.5 cm or more, about 3 cm or more, about 3.5 cm or more, about 4 cm or more, about 5 cm or more, about 6 cm or more, about 7 cm or more, about 8 cm or more, about 9 cm or more, about 12.5 cm or more, about 15 cm or more, about 17.5 cm or more, about 20 cm or more, about 25 cm or more, about 30 cm or more, or in ranges of about 0.25 cm to about 0.75 cm, about 0.5 cm to about 1 cm, about 0.75 cm or about 1.25 cm, about 1 cm to about 1.5 cm, about 1.25 cm to about 1.75 cm, about 1.5 cm to about 2 cm, about 1.75 cm to about 2.5 cm, about 2 cm to about 3 cm, about 2.5 cm to about 3.5 cm, about 3 cm to about 4 cm, about 3.5 cm to about 5 cm, about 4 cm to about 6 cm, about 5 cm to about 7 cm, about 6 cm to about 8 cm, about 7 cm to about 9 cm, about 8 cm to about 10 cm, about 9 cm to about 12.5 cm, about 10 cm to about 15 cm, about 12.5 cm to about 17.5 cm, about 15 cm to about 20 cm, about 17.5 cm to about 25 cm, or about 20 cm to about 30 cm. In an example, the cutouts 128 may be configured to cause the width $W_Y$ of the yielding region 116 to be smaller than at least one of the width $W_F$ of the first attachment region 110 or the width $W_S$ of the second attachment region 112 by about 1% to about 5%, about 2.5% to about 7.5%, about 5% to about 10%, about 7.5% to about 15%, about 10% to about 20%, about 15% to about 25%, about 20% to about 30%, about 25% to about 35%, about 30% to about 40%, about 35% to about 45%, about 40% to about 50%, about 45% to about 55%, about 50% to about 60%, about 55% to about 65%, about 60% to about 70%, about 65% to about 75%, about 70% to about 80%, or about 75% to about 85%. The difference between the width $W_Y$ of the yielding region 116 and the widths $W_F$, $W_S$ of the first and second attachment regions 110, 112 may depend on the size of the structure 100, the maximum expected movement between the first and second structural elements 102, 104 when a severe load is applied to the structure 100, and the desired load at which the yielding region 116 yields.

In an example, as shown, any corners formed by the cutout 128 are rounded (e.g., exhibit an average radius of curvature that is greater than 0.25 cm). The rounded corners of the cutout 128 prevent or at least inhibit the formation of stress concentrators which may cause the yielding region 116 to prematurely yield. Further, corners formed by the cutout 128 are typically close to the first and second attachment regions 110, 112 and such stress concentrators may cause the first and second attachment regions 110, 112 to yield instead of or in addition to the yielding region 116. In an example, any corners formed by the cutout 128 are not rounded.

The structural fuse 108 may include weakening features other than or in addition to the cutouts 128. Examples of other weakening features includes selectively thinning the yielding region 116 relative to the first and second attachment regions 110, 112 and forming the yielding region 116 from a weaker material (i.e., a material exhibiting a yielding stress) that is less than a material forming the first and second attachment regions 112, 112.

In an embodiment, the yielding region 116 may include one or more internal cutouts formed therein that are spaced from the peripheral edges of the 130 of the structural fuse 108. It is noted that such internal cutouts are distinguishable from the slot 132 (discussed below) in that such internal cutouts are not configured to receive bolts 112 or rivets and/or do not include bolts 122 or rivets positioned therein.

The structure 100 is configured to prevent the yielding region 116 from buckling when a compressive load is applied to the yielding region 116. For example, allowing the yielding region 116 to buckle significantly decreases a load that causes the yielding region 116 to yield than if the yielding region 116 is prevented from buckling. Further, allowing the yielding region 116 to buckle significantly weakens the structure 100. In an embodiment, as illustrated, the yielding region 116 is attached to the second structural element 104 using bolts 134. The bolts 134 provide discrete (partial) out-of-plane restraint thereabout that prevents the yielding region 116 from buckling. It has been found that the discrete out-of-plane restraint provided by the bolts 134 is sufficient to prevent buckling of the yielding region 116. It is noted that the structure 100 may include rivets or other similar element instead of or in addition to the bolts 134.

The discrete out-of-plane restraint provided by the bolts 134 is different from conventional buckling restraint systems since conventional buckling restraint systems rely on continuous out-of-plane restraint to prevent buckling. In an example, a conventional buckling restraint system includes a buckling restraint brace. The buckling restrained brace relies on concrete, motor, cement, or other similar material (collectively referred to as "concrete") disposed between the outer shell and the inner brace to provide continuous out-of-plane restraint to prevent buckling of the brace. However, the concrete or other filler causes the buckling restrained brace to exhibit exceptionally high weight which, in turn, requires strengthening the structure including the buckling restrained brace to accommodate the additional weight. The structures disclosed herein (e.g., structures including a structural fuse) do not require concrete or other filler to prevent buckling of the yielding region 116. In an example, a conventional buckling restrained system includes a Simpson yield link. The Simpson yield link requires the use of an additional plate adjacent to a yielding element to provide continuous out-of-plane buckling of the yielding element. However, the additional plate of the Simpson yielding link increases the complexity of installing the Simpson yield link. However, the structures disclosed herein (e.g., structures including a structural fuse) may not include the additional plate and/or the filler element thereby making the structures disclosed herein less complex and more likely to be installed correctly.

The yielding region 116 defines one or more slots 132. The slots 132 allow the yielding region 116 to be attached to the second element 104 with the bolts 134 and allows the bolts 134 to prevent buckling of the yielding region 116. For example, the yielding region 116 allows the shaft of the bolts 134 to pass through the structural fuse 108 and be attached to the second structural element 104. However, the yielding region 116 exhibits a size that does not permit the head of the bolt 134 to pass therethrough thereby allowing the head of the bolt 134 to provide discrete out-of-plane restraint.

The slots 132 are configured to allow the bolts 134 to move relative to the yielding region 116. In particular, the slots 132 exhibit a size that is greater than and/or shape that is different than the shaft of the bolt 134 which permits the shaft to move in the slot 132. In an example, the slots 132 may exhibit a generally elongated shape that extends generally parallel to the longitudinal axis 114 of the structural fuse 108. In such an example, the elongated shape of the slots 132 allows the shafts of the bolts 134 to move in a direction that is generally parallel to the longitudinal axis 114 relative to the yielding region 116. Examples of elongated shapes that the slots 132 may exhibit include generally oval, oblong, elliptical, rectangular, or rectangular racetrack.

Allowing the shafts of the bolts 134 to move relative to the yielding region 116 also allows the first and second structural elements 102, 104 to move relative to the yielding region 116. Allowing the first and second structural elements 102, 104 to move relative to the yielding region 116 causes the yielding region 116 to absorb at least some of the energy applied to the structure 100 (e.g., energy caused by earthquakes and wind). It also allows the yielding region 116 to shorten or lengthen depending on the movement of the first structural element 102 relative to the second structural element 104.

It is noted that the slots 132 exhibit a size that is sufficiently large that the shaft of the bolts 134 are unlikely to contact opposing portions of the slots 132 that are spaced from each other in a direction that is parallel to the longitudinal axis 114. For example, allowing the shafts to contact such opposing portions of the slots 132 prevents further movement of the first and second structural elements 102, 104 in one direction relative to the yielding region 116. Preventing further movement of the first and second structural elements 102, 104 relative to the yielding region 116 effectively makes the attachment between the second structural element 104 and the yielding region 116 a rigid attachment. This rigid attachment between the second structural element 104 and the yielding region 116 limits the ability of the yielding region 116 to absorb energy applied to the structure 100, increases the likelihood that the first and second structural elements 102, 104 yield, and increases the likelihood that the first and second attachment regions 110, 112 yield.

It is noted that the bolts 134 may prevent at least some movement between second structural element 104 and the yielding region 116 due to static friction between the yielding region 116 and the second structural element 104 and static friction between the bolts 134 and the yielding region 116. This restriction of movement caused by the static friction is considered negligible because the static friction is overcome by a load that is less than the load required to yield any one the first structural element 102, the second structural element 104, the first attachment region 110, the second attachment region 112, the rigid attachment between the first structural element 102 and the first attachment region 110, and the rigid attachment between the second structural element 104 and the second attachment region 112. In an example, the static friction between the second structural element 104, the yielding region 116, and the bolt 134 may be reduced by loosening the bolt 134 relative to the bolts 122. In an example, the static friction between the second structural element 104, the yielding region 116, and the bolts 134 may be reduced by applying lube (e.g., oil, grease, graphite) between at least one of the second structural element 104 and the yielding region 116 or the yielding region 116 and the head of the bolt 134.

The yielding region 116 may be configured to yield when a tensile or compressive load and not a shear load is applied thereto. In an example, the yielding region 116 may be configured to yield when a tensile or compressive load is applied thereto when the slots 132 are generally centrally aligned with the longitudinal axis 114. Generally centrally aligning the slots 132 with the longitudinal axis 114 ensures that the yielding region 116 yields when a tensile or compressive load is applied thereto. In an example, when the structural fuse 108 defines bolt holes 124, the slots 132 are arranged in one or more rows that are aligned with the one or more rows of the bolt holes 124. For instance, in the illustrated embodiment, the slots 132 are aligned in two rows that are aligned with and parallel to the two rows of bolt holes 124. In an example, the slots 132 exhibit an elongated shape and the elongated shape is generally parallel to the longitudinal axis 114 and/or aligned with the one or more rows of bolt holes 124. Aligning the elongated shape of the slots 132 with the longitudinal axis 114 ensures that the yielding region 116 yields when a tensile or compressive load is applied thereto.

Figure 1C:
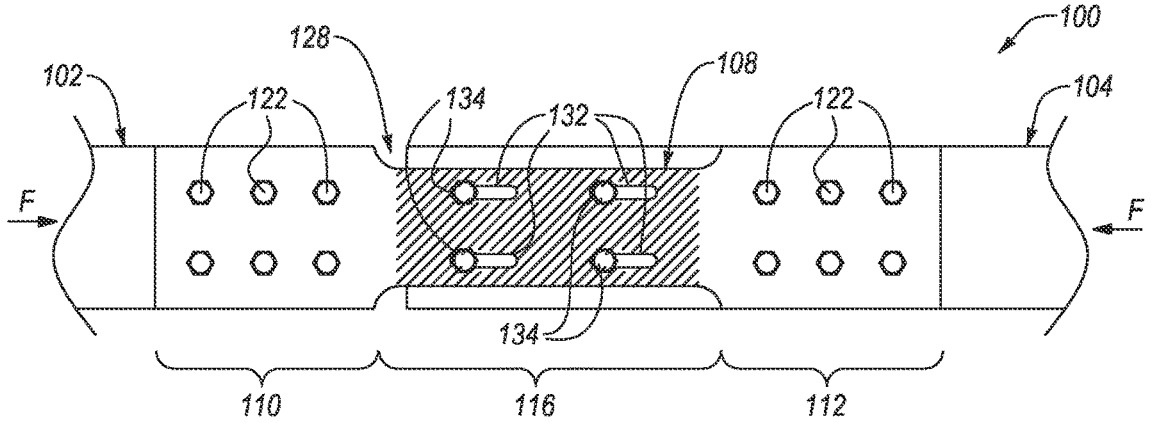
FIG. 1C is a bottom plan view of the structure when an external compressive load is applied to the structure that is sufficiently large to yield the structural fuse, according to an embodiment.

FIGS. 1B and 1C illustrate how the structural fuse 108 absorbs energy when a load is applied to the structure 100. FIG. 1B illustrates the structure 100 when no external load is applied to the structure 100. When no external load is applied to the structure 100, the first and second structural elements 102, 104 are spaced from each other by the gap 106 (illustrated in FIG. 1B, partially obscured in FIG. 1A) and the bolts 134 are generally centrally located in the slots 132. FIG. 1C is a bottom plan view of the structure 100 when an external compressive load F is applied to the structure 100 that is sufficiently large to yield the structural fuse 108, according to an embodiment. The compressive load F causes the first and second structural elements 102, 104 to move closer together. Moving the first and second structural elements 102, 104 closer together also causes the first and second attachment regions 110, 112 of the structural fuse 108 to move closer together due to the rigid attachment between the first structural element 102 and the first attachment region 110 and the rigid attachment between the second structural element 104 and the second attachment region 112. Moving the first and second attachment regions 110, 112 closer together may be sufficient to cause the yielding region 116 to yield, as shown in FIG. 1C using cross-hatching. Yielding the yielding region 116 causes the structural fuse 108 to absorb at least some of the energy applied to the structure 100. Also, the second structural element 104 is able to move relative to the yielding region 116 (as indicated by the bolts 134 moving the left side of the slots 132) thereby allowing the movement of the second structural element 104 to absorb at least some of the energy and minimizing loads being applied from the yielding region 116 to the second structural element 104. The out-of-plane restraint provided by the bolts 134 prevents the yielding region 116 from buckling thereby increasing the compressive load F required to yield the yielding region 116.

Although FIG. 1C illustrates a compressive load F being applied to the structure 100, it is noted that a tensile load may be applied to the structure 100. The tensile load causes the first and second structural elements 102, 104 to move further apart. Moving the first and second structural elements 102, 104 apart also causes the first and second attachment regions 110, 112 of the structural fuse 108 to move further apart due to the rigid attachment between the first structural element 102 and the first attachment region 110 and the rigid attachment between the second structural element 104 and the second attachment region 112. Moving the first and second attachment regions 110, 112 apart may be sufficient to cause the yielding region 116 to yield. Yielding the yielding region 116 causes the structural fuse 108 to absorb at least some of the energy applied to the structure 100. Also, the second structural element 104 is able to move relative to the yielding region 116 thereby allowing the movement of the second structural element 104 to absorb at least some of the energy and minimize loads being applied from the yielding region 116 to the second structural element 104.

Figure 2:
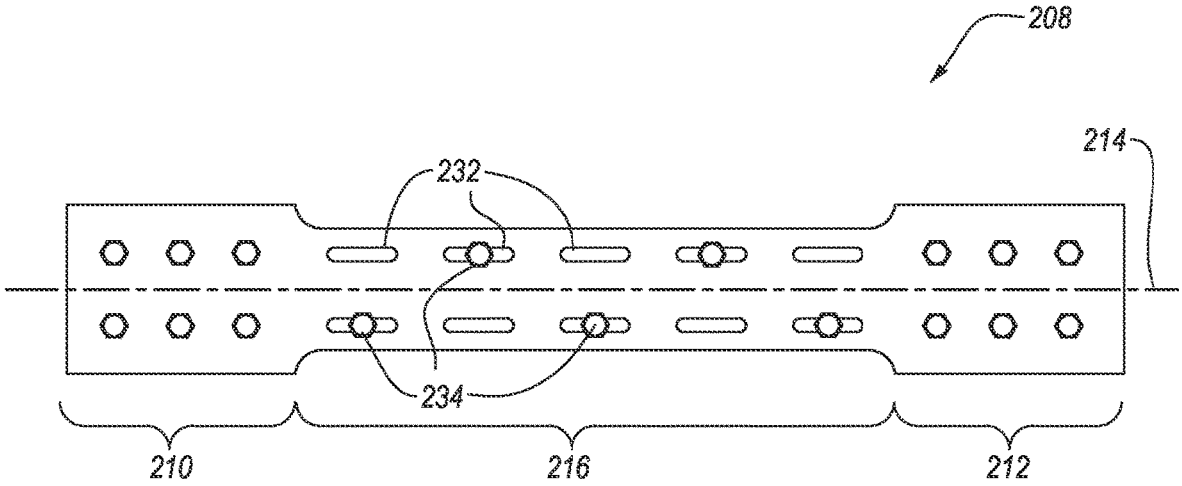
FIG. 2 is a bottom plan view of a structural fuse, according to an embodiment.

The structures disclosed herein may include structural fuses that are different than the structural fuse 108 illustrated in FIGS. 1A-1C. For example, FIG. 2 is a bottom plan view of a structural fuse 208, according to an embodiment. Except as otherwise disclosed herein, the structural fuse 208 is the same or substantially similar to any of the structural fuses disclosed herein. For example, the structural fuse 208 includes a first attachment region 210 that is configured to be rigidly attached to a first structural element (not shown), a second attachment region 212 that is configured to be rigidly attached to the second structural element (not shown), and a yielding region 216 extending between the first and second attachment regions 210, 212.

The yielding region 216 includes a plurality of slots 232. In an example, as illustrated, the plurality of slots 232 may be arranged in two or more rows. Each of the rows may extend generally parallel to a longitudinal axis 214 of the structural fuse 208. The plurality of slots 232 may also be arranged in one or more columns. The columns may extend generally perpendicular to the longitudinal axis 214 of the structural fuse 208. Arranging the slots 232 in the two or more rows and the one or more columns causes any loads applied to the structural fuse 208 to be generally uniformly applied to the yielding region 216. Generally uniformly applying the loads to the yielding region 216 promotes distributed yielding in the yielding region 216.

In an embodiment, not shown, each of the slots 232 includes a bolt 234 partially positioned therethrough. In an embodiment, as shown, only some of the slots 232 includes a bolt 234 partially positioned therethrough. It has been found that positioning the bolts 234 in some of the slots 232 (e.g., in only one slot 232 in each column and/or in every other slot 232) may provide sufficient out-of-plane restraint to prevent or at least inhibit buckling of the yielding region 216.

Figure 3A:
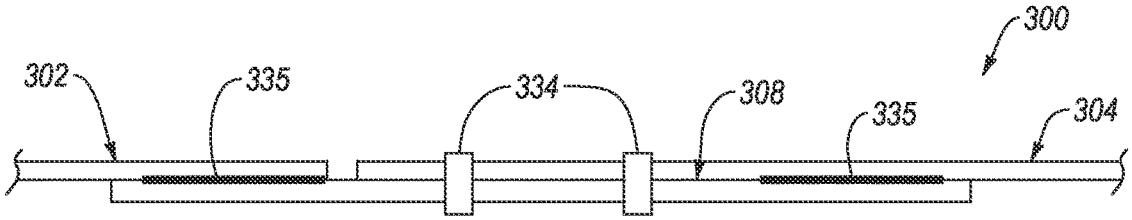
FIGS. 3A and 3B are side elevational and bottom plan views, respectively, of a structure that includes one or more straps moveably attaching a yielding region of a structural fuse to a second structural element, according to an embodiment.
Figure 3B:
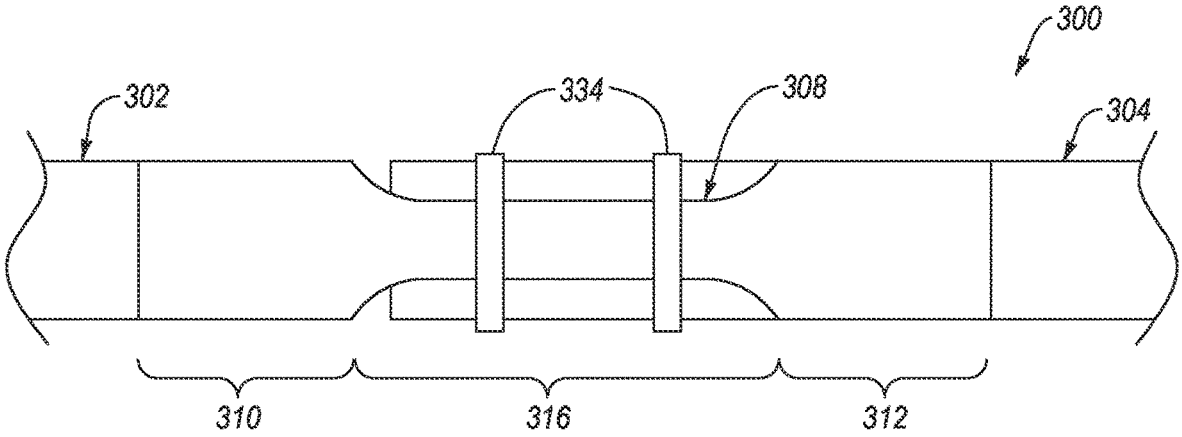

As previously discussed, the yielding region of the structural fuses disclosed herein may be moveably attached to the second structural element using one or more techniques instead of or in addition to the bolts. For example, FIGS. 3A and 3B are side elevational and bottom plan views, respectively, of a structure 300 that includes one or more straps 334 moveably attaching a yielding region 316 of a structural fuse 308 to a second structural element 304, according to an embodiment. Except as otherwise disclosed herein, the structure 300 is the same or substantially similar to any of the structures disclosed herein. For example, the structure 300 includes a first structural element 302, a second structural element 304, and a structural fuse 308. The structural fuse 308 includes a first attachment region 310 rigidly attached (e.g., via a weld 335, shown using a bolded line) to the first structural element 302, a second attachment region 312 rigidly attached (e.g., via a weld 335, shown using a bolded line) to the second structural element 304, and a yielding region 316 between the first and second attachment regions 310, 312.

The yielding region 316 is moveably attached to the second structural element 304 using one or more straps 334 (e.g., one or more metal straps). The straps 334 extend at least partially around the second structural element 304 and the yielding region 316 thereby moveably attaching the second structural element 304 to the yielding region 316. The straps 334 provide discrete out-of-plane restraint thereabout that prevents the yielding region 316 from buckling. It has been found that the discrete out-of-plane restraint provided by the straps 334 is sufficient to prevent buckling of the yielding region 316. In an embodiment, the straps 334 are rigidly attached to one of the second structural element 304 or the yielding region 316 using, for example, an adhesive, a weld, or another suitable attachment technique. In an embodiment, the straps 334 are not rigidly attached to either of the second structural element 304 or the yielding region 316.

Attaching the second structural element 304 to the yielding region 316 using the one or more straps 334 may facilitate manufacturing and configurability of the yielding region 316. In an example, attaching the second structural element 304 to the yielding region 316 using the one or more straps 334 precludes the need to form one or more slots in the yielding region 316. The lack of slots formed in the yielding region may allow a load to be more uniformly applied to the yielding region than if the yielding region 316 included slots and prevents any weakening of the yielding region caused by the slots.

As previously discussed, the structural fuses disclosed herein may be used in structures other than the structures illustrated in FIGS. 1A-1C, 3A, and 3B. FIGS. 4A-8B illustrate different structures that may include any of the structural fuses disclosed herein. Except as otherwise disclosed herein, the structures and structural fuses illustrated in FIGS. 4A-8B are the same as or substantially similar to any of the structures and structural fuses disclosed herein, respectively. It is noted that the structures illustrated in FIGS. 4A-8B are merely examples of structures that may include the structural fuses disclosed herein. In other words, the structural fuses disclosed herein may be used in structures other than the structures illustrated in FIGS. 1A-1C, 3A, 3B, and 4A-8B.

FIGS. 4A-4C are side elevational, bottom plan, and top plan views, respectively, of a structure 400, according to an embodiment. The structure 400 is an example of a beam-to-column connection. The structure 400 includes a column 402 (i.e., a first structural element) and a beam 404 (i.e., a second structural element). In the illustrated embodiment, the column 402 and beam 404 are illustrated as being I-beams. However, it is noted that the column 402 and the beam 404 may include plates, hollow structural sectionals, T-beams, or any other suitable structural element.

Referring to FIGS. 4A and 4B, the column 402 and the beam 404 are attached together using a structural fuse 408. The structural fuse 408 includes a first attachment region 410, a second attachment region 412, and a yielding region 416 extending between the first and second attachment regions 410, 412. The first attachment region 410 is rigidly attached to the column 402, such as to a flange 436 of the column 402. The second attachment region 412 is rigidly attached (e.g., directly or indirectly) to the beam 404, such as to a flange 440 of the beam 404. The structural fuse 408 is moveably attached to the beam 404.

In an example, not shown, the first attachment region 410 is directly rigidly attached to the column 402 using, for instance, a weld or one or more bolts (e.g., the first attachment region 410 is an angle). In an example, as shown, the first attachment region 410 is indirectly rigidly attached to the column 402, for instance, using a first (e.g., bottom) plate 438. The first plate 438 may be attached to the column 402 (e.g., using a weld, bolts, etc.) before assembling the structure 400 in the field which may facilitate assembly of the structure 400. In an example, the second attachment region 412 is directly or indirectly attached to the beam 404.

In an example, as illustrated, the structural fuse 408 includes one or more slot 432 and the structural fuse 408 is attached to the beam 404 using one or more bolts 434. In an example, not shown, the structural fuse 408 is attached to the beam 404 using one or more straps, one or more clamps, one or more rivets, or using any other suitable technique.

In an embodiment, as shown, the structural fuse 408 may be attached to the bottom side (e.g., the bottom flange 440) of the beam 404. Attaching the structural fuse 408 to the bottom side of the beam 404 may facilitate inspecting, repairing, and/or replacing of the structural fuse 408. For example, floors are typically positioned on the top side (e.g., top flange 442) of the beam 404. The floors may include concrete or other elements that make accessing the top side of the beam 404 difficult. Meanwhile, a ceiling is generally positioned adjacent to the bottom side of the beam 404. The ceiling may include drop ceiling tiles or include another material that is easier to remove than the floor. Thus, attaching the structural fuse 408 to the bottom side of the beam 404 makes accessing the structural fuse 408 easier which facilitate inspecting, repairing, and replacing the structural fuse 408.

Referring to FIGS. 4A and 4C, the top side (e.g., top flange 442) of the second structural element 404 may be attached to the column 402. In an embodiment, as illustrated, the top side of the beam 404 is attached to the column 402 using a second (e.g., top) plate 444 or another element other than a structural fuse 408 that is not configured to preferentially yield like the structural fuse 408. As previously discussed, the top side of the beam 404 may be difficult to access and thus, attaching the top side of the beam 404 using an element other than a structural fuse 408 reduces the likelihood that the top side of the beam 404 needs to be accessed to repair the structure 400. In an embodiment, the top side of the beam 404 may be attached to the column 402 using a structural fuse. In an embodiment, the flange 436 of the column 402 may be attached to the web 446 of the beam 404 using a shear tab 448.

Due to the structural fuse 408, the structure 400 exhibits adequate stiffness and is able to accommodate large deformations without losing strength. The structure 400 may also be a fully restrained connection since the first plate 438 and the second plate 444 may be welded to the column 402. The structural fuse 408 also allows the structure 400 to be more easily repaired compared to other conventional beam-to-column connections.

Figure 5A:
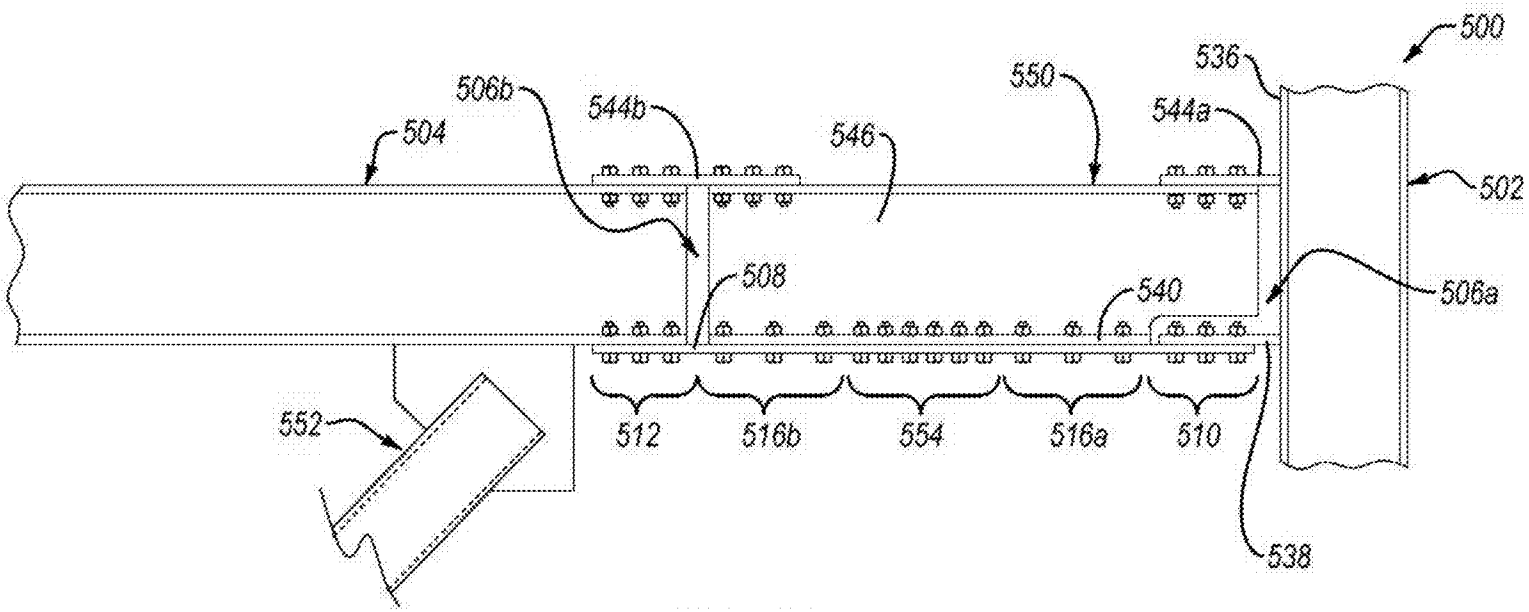
FIGS. 5A and 5B are side elevational and bottom plan views, respectively, of a structure, according to an embodiment.
Figure 5B:
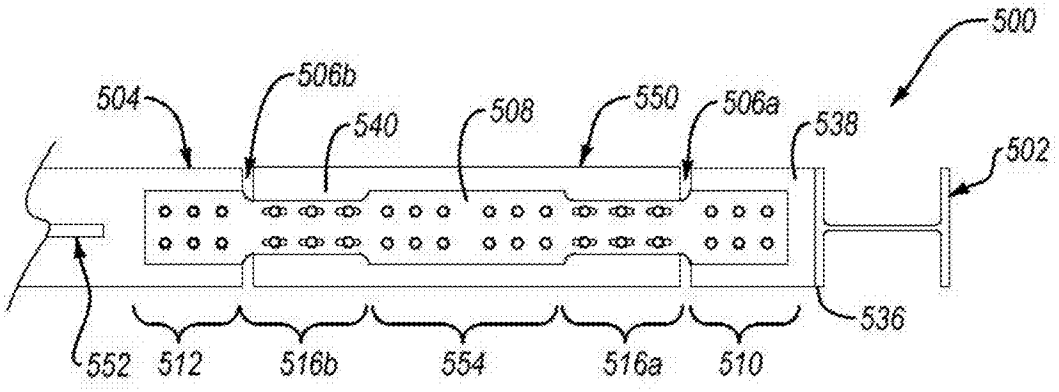

FIGS. 5A and 5B are side elevational and bottom plan views, respectively, of a structure 500, according to an embodiment. The structure 500 is an eccentrically braced frame. The structure 500 includes a column 502 (i.e., a first structural element), a beam 504 (i.e., a second structural element), a link beam 550 (i.e., a third structural element), and a brace 552 (i.e., a fourth structural element). The brace 552 is attached to the rest of the structure 500 (i.e., the beam 504) at some distance from the column 502 and the link beam 550 extends between the beam 504 to the column 502. It is noted that the beam 504 may extend pass the brace 552 thereby providing a location for the structural fuse 508 to be attached.

The structure 500 includes at least one structural fuse 508. The at least one structural fuse 508 may attach the column 502, the beam 504, and link beam 550 together. The at least one structural fuse 508 may also maintain a first gap 506*a* between the column 502 and the link beam 550 when no external load is applied to the structure 500 thereby allowing movement between the column 502 and the link beam 550 when a load is applied to the structure 500. In the illustrated embodiment, the first gap 506*a* is between the web 546 of the link beam 550 and the flange 536 of the column 502 and between the flange 540 of the link beam 550 and the plate 538 when the structural fuse 508 is indirectly attached to the column 502 using the plate 538. The at least one structural fuse 508 may also maintain a second gap 506*b* between the beam 504 and the link beam 550 when no external load is applied to the structure 500 thereby allowing movement between the beam 504 and the link beam 550 when a load is applied to the structure 500.

In an embodiment, as shown, the structure 500 includes a single structural fuse 508 that is configured to be attached to each of the column 502, the beam 504, and the link beam 506. In such an embodiment, the structural fuse 508 includes a first attachment region 510 that is configured to be rigidly attached to the column 502 (e.g., via a plate 538), a second attachment region 512 that is configured to be rigidly attached to the beam 504, and a third attachment region 554 positioned between the first and second attachment regions 510, 512 that is configured to be rigidly attached to the link beam 550. It is noted that the third attachment region 554 may be the same or substantially similar to any of the attachment regions disclosed herein. The structural fuse 508 includes a first yielding region 516*a* extending between the first and third attachment regions 510, 554 and a second yielding region 516*b* extending between the second and third attachment regions 512, 554. The first and second yielding regions 516*a*, 516*b* may be moveably attached to the link beam 550 using any of the techniques disclosed herein. In an embodiment, not shown, the structure 500 may include two or more structural fuses that attach the column 502, the beam 504, and the link beam 550 together. For example, in such an embodiment, the structure 500 may include a first structural fuse that attaches the column 502 to the link beam 550 and a second structural fuse that attaches the beam 504 to the link beam 550. It is noted that using only a single structural fuse 508 to attach each of the column 502, the beam 504, and the link beam 550 together requires less pieces (i.e., makes assembly of the structure 500 less complex and less likely to be installed incorrectly) than if first and second structural fuses are used to attach the column 502, the beam 504, and the link beam 550 together. However, using a single structural fuse 508 requires replacing the whole structural fuse 508 if only one yielding region yields whereas using the first and second structural fuses allows for a more targeted repair that wastes less material.

In an embodiment, the structural fuse 508 may be attached to the bottom sides of the beam 504 and the link beam 550 to facilitate replacement of the structural fuse 508 after the structural fuse 508 yields, for reasons previously discussed. In such an embodiment, one or more elements may be attached to the top sides of the beam 504 and the link beam 550 to attach the column 502, the beam 504, and the link beam 550 together. The one or more elements may be configured to not preferentially yield such that repair of the one or more elements is unlikely. The one or more elements may include a first top plate 544*a* that attaches the column 502 to the top side of the link beam 550 and a second top plate 544*b* that attaches the top side of the beam 504 to the top side of the link beam 550. In an embodiment, the structure 500 may include a structural fuse attached to the top side of the beam 504 and the link beam 550 instead of or in addition to the structural fuse 508 attached to the bottom side of the beam 504 and the link beam 550.

The structural fuse 508 provides several advantages over conventional eccentrically braced frames. For example, the structural fuse 508 may accelerate construction of the eccentrically braced frame illustrated in FIGS. 5A and 5B compared to a fully-welded eccentrically braced frame. The structural fuse 508 may also result in better control of loads applied to the structure 500 compared to a conventional eccentrically braced frame. The structural fuse 508 further makes it easier to inspect and repair the structure 500 (e.g., after an earthquake) compared to a conventional eccentrically braced frames.

Figure 6:
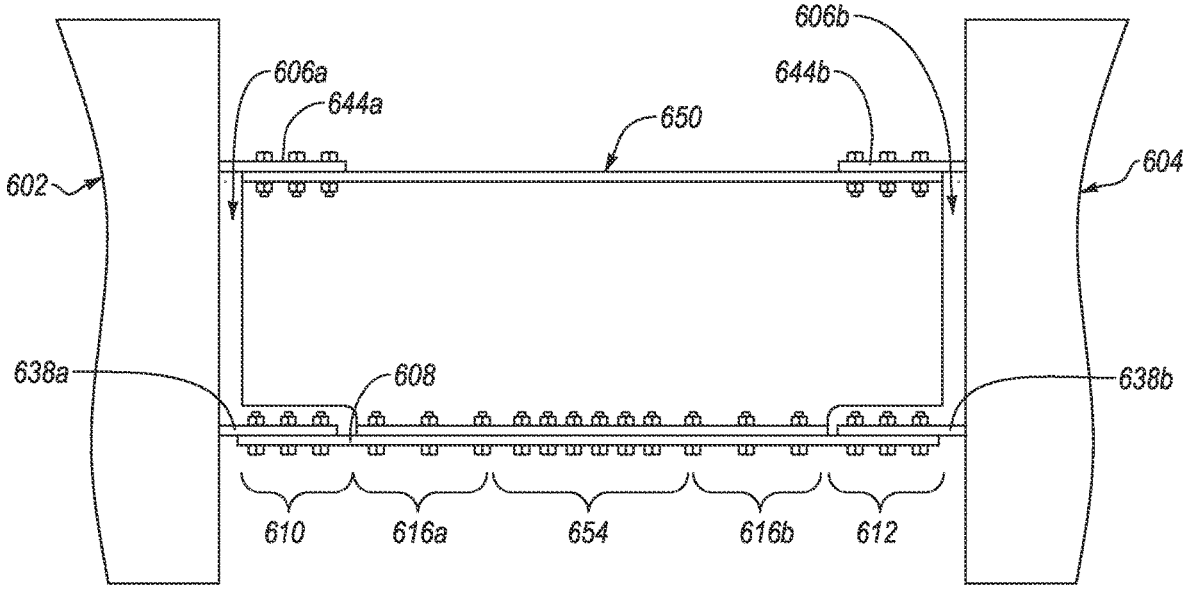
FIG. 6 is a side elevational view of a structure, according to an embodiment.

FIG. 6 is a side elevational view of a structure 600, according to an embodiment. The structure 600 is an example of a concrete shear walls or concrete steel coupled walls. The structure includes a first wall 602 (i.e., a first structural element), a second wall 604 (e.g., a second structural element), and a coupling beam 650 (i.e., a third structural element).

The structure 600 includes at least one structural fuse 608. The at least one structural fuse 608 may attach the first wall 602, the second wall 604, and coupling beam 650 together. The at least one structural fuse 608 may also maintain a first gap 606*a* between the first wall 602 and the coupling beam 650 when no external load is applied to the structure 600 thereby allowing movement between the first wall 602 and the coupling beam 650 when a load is applied to the structure 600. The at least one structural fuse 608 may also maintain a second gap 606*b* between the second wall 604 and the coupling beam 650 when no external load is applied to the structure 600 thereby allowing movement between the second wall 604 and the coupling beam 650 when a load is applied to the structure 600. It is noted that the first and second gaps 606*a*, 606*b* include the gaps between the coupling beam 650 and the plates 638*a*, 638*b*.

In an embodiment, as shown, the structure 600 includes a single structural fuse 608 that is configured to be attached to each of the first wall 602, the second wall 604, and the coupling beam 650. In such an embodiment, the structural fuse 608 includes a first attachment region 610 that is configured to be rigidly attached to the first wall 602 (e.g., via a first bottom plate 638*a*), a second attachment region 612 that is configured to be rigidly attached to the second wall 604 (e.g., via a second bottom plate 638*b*), and a third attachment region 654 positioned between the first and second attachment regions 610, 612 that is configured to be rigidly attached to the coupling beam 650. The structural fuse 608 includes a first yielding region 616*a* extending between the first and third attachment regions 610, 654 and a second yielding region 616*b* extending between the second and third attachment regions 612, 654. The first and second yielding regions 616*a*, 616*b* may be moveably attached to the coupling beam 650 using any of the techniques disclosed herein. In an embodiment, not shown, the structure 600 may include two or more structural fuses that attach the first wall 602, the second wall 604, and the coupling beam 650 together. For example, in such an embodiment, the structure 600 may include a first structural fuse that attaches the first wall 602 to the coupling beam 650 and a second structural fuse that attaches the second wall 604 to the coupling beam 650. It is noted that using only a single structural fuse 608 to attach the first wall 602, the second wall 604, and the coupling beam 650 together requires less pieces (i.e., makes assembly of the structure 600 less complex and less likely to be installed incorrectly) than if the first and second structural fuses are used to attach the first wall 602, the second wall 604, and the coupling beam 650 together. However, using a single structural fuse 608 requires replacing the whole structural fuse 608 if only one yielding region yields whereas using the first and second structural fuses allows for a more targeted repair that wastes less material.

In an embodiment, the structural fuse 608 may be attached to the bottom sides of the second wall 604 and the coupling beam 650 to facilitate replacement of the structural fuse 608 after the structural fuse 608 yields. In such an embodiment, one or more elements may be attached to the top sides of the second wall 604 and the coupling beam 650 to attach the first wall 602, the second wall 604, and the coupling beam 650 together. The one or more elements may be configured to not preferentially yield such that repair of the one or more elements is unlikely. The one or more elements may include a first top plate 644*a* that attaches the first wall 602 to the top side of the coupling beam 650 and a second top plate 644*b* that attaches the top side of the second wall 604 to the top side of the coupling beam 650. In an embodiment, not shown, the structure 600 may include a structural fuse 608 attached to the top side of the second wall 604 and the coupling beam 650 instead of or in addition to the structural fuse 608 attached to the bottom side of the second wall 604 and the coupling beam 650.

The structural fuse 608 provides several advantages over conventional coupled concrete shear walls or concrete steel coupled walls. For example, the structural fuse 608 may accelerate construction of the structure 600 and be easier to construct compared to conventional coupled concrete shear walls or concrete steel coupled walls. The structural fuse 608 also results in better control of loads applied to the structure 600 compared to conventional coupled concrete shear walls or concrete steel coupled walls. The structural fuse 608 further makes it easier to inspect and repair the structure 600 (e.g., after an earthquake) compared to a conventional coupled concrete shear walls or concrete steel coupled walls.

Figure 7B:
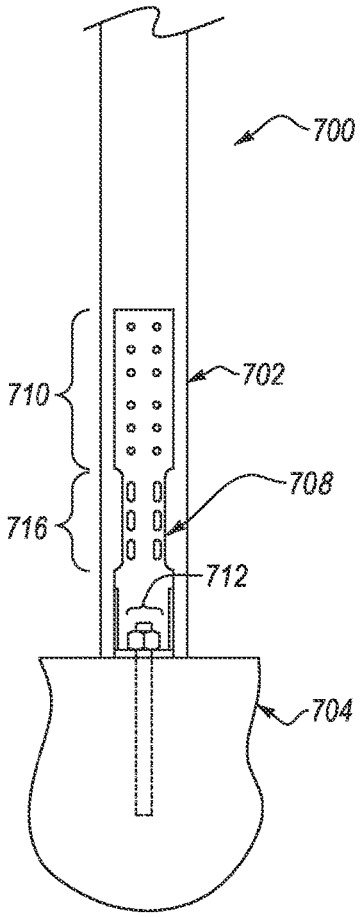

FIGS. 7A and 7B are a side elevational and front elevational view of a structure 700, according to an embodiment. The structure 700 is an example of a framing structure or a shear wall, such as timber framing and a timber shear wall. The structure 700 includes a wall 702 (i.e., first structural element) and a floor 704 (i.e., a second structural element). It is noted that, in some embodiments, the wall 702 may be replaced with a column and/or the floor 704 may be replaced with a foundation.

The structure 700 includes a structural fuse 708. The structural fuse 708 may attach the wall 702 and the floor 704 together. The structural fuse 708 includes a first attachment region 710 that is configured to be rigidly attached to the wall 702 and a second attachment region 712 that is configured to be rigidly attached to the floor 704. Since the wall 702 and the floor 704 extend perpendicularly to each other, the structural fuse 708 has a 90° bend at the end. The structural fuse 708 also includes a yielding region 716 extending between the first and second attachment regions 710, 712. The yielding region 716 may be moveably attached to the wall 702 (as shown) or the floor 704 using any of the techniques disclosed herein.

FIG. 8A is a side elevational view of a structure 800, according to an embodiment. FIG. 8B is a cross-sectional view of the structure 800 taken along plane 8B-8B. The structure 800 is an example of a buckling-restrained brace. The structure includes a first hollow structural section 802 (i.e., a first structural element), a second hollow structural section 804 (i.e., a second structural element), and a third hollow structural section 850 (i.e., a third structural element). The first and third hollow structural sections 802, 850 are separated by a first gap 806*a* that accommodates movement between the first and third hollow structural sections 802, 850. The second and third hollow structural sections 804, 850 are separated by a second gap 806*b* that accommodates movement between the second and third hollow structural sections 804, 850. It is noted that the first and second hollow structural sections 802, 804 may define one or more recesses 860 formed therein that facilitate attachment of the structure 800 to a larger structure.

The structure 800 includes at least one structural fuse 808. The at least one structural fuse 808 may attach the first hollow structural section 802, the second hollow structural section 804, and third hollow structural section 850 together. The at least one structural fuse 808 may also maintain a first gap 806*a* between the first hollow structural section 802 and the third hollow structural section 850 when no external load is applied to the structure 800 thereby allowing movement between the first hollow structural section 802 and the third hollow structural section 850 when a load is applied to the structure 800. The at least one structural fuse 808 may also maintain a second gap 806*b* between the second hollow structural section 804 and the third hollow structural section 850 when no external load is applied to the structure 800 thereby allowing movement between the second hollow structural section 804 and the third hollow structural section 850 when a load is applied to the structure 800. It is noted that the structural fuse 808 may also define the one or more recesses 860 to facilitate attachment of the structure 800 to a larger structure.

In an embodiment, as shown, the structure 800 includes at least one structural fuse 808 that is configured to be attached to each of the first hollow structural section 802, the second hollow structural section 804, and the third hollow structural section 850. For example, as illustrated, the structure 800 includes four structural fuses 808 (one for each surface of the hollow structural sections) that are each configured to be attached to the first hollow structural section 802, the second hollow structural section 804, and the third hollow structural section 850. In such an embodiment, the structural fuse 808 includes a first attachment region 810 that is configured to be rigidly attached to the first hollow structural section 802 (e.g., via a first weld 862, illustrated using a bolded line), a second attachment region 812 that is configured to be rigidly attached to the second hollow structural section 804 (e.g., via a second weld 864, illustrated using a bolded line), and a third attachment region 854 positioned between the first and second attachment regions 810, 812 that is configured to be rigidly attached to the third hollow structural section 850 (e.g., via a third weld 866, illustrated using a bolded line). The structural fuse 808 includes a first yielding region 816*a* extending between the first and third attachment regions 810, 854 and a second yielding region 816*b* extending between the second and third attachment regions 812, 854. The first and second yielding regions 816*a*, 816*b* may be moveably attached to the third hollow structural section 850 using any of the techniques disclosed herein, such as using straps 834. It is noted that, in the illustrated embodiment, the third attachment region 850 exhibits a width that is substantially the same as the widths of the first and second yielding regions 816*a*, 816*b*. However, it is noted that the third attachment region 850 may exhibit a width that is greater than the widths of the first and second yielding regions 816*a*, 8*a*6*b*.

In an embodiment, not shown, the structure 800 may include a first structural fuse that attaches the first hollow structural section 802 to the third hollow structural section 850 and a second structural fuse that attaches the second hollow structural section 804 to the third hollow structural section 850. It is noted that using only a single structural fuse 808 to attach each of the first hollow structural section 802, the second hollow structural section 804, and the third hollow structural section 850 together requires less pieces (i.e., makes assembly of the structure 800 less complex and less likely to be installed incorrectly) than if the first and second structural fuses are used to attach the first hollow structural section 802, the second hollow structural section 804, and the third hollow structural section 850 together.

The structure 800 may be easier to fabricate using an automated process than conventional buckling-restrained braces. The structural fuses 808 makes inspecting and repairing the structure 800 easier than conventional buckling-restrained braces since the structural fuses 808 are on the exterior of the structure 800 whereas the yielding elements of conventional buckling-restrained braces are on the interior of such braces and surrounded by concrete. Also, replacing the structural fuses 808 allows the first, second, and third hollow structural sections 802, 804, 850 to remain in place whereas replacing the yielding element of the conventional buckling-restrained brace requires removing all of the conventional buckling-restrained brace. Further, the structure 800 may weight substantially less than a conventional buckling-restrained brace.

While various aspects and embodiments have been disclosed herein, other aspects and embodiments are contemplated. The various aspects and embodiments disclosed herein are for purposes of illustration and are not intended to be limiting.

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or ±2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

What is claimed is:

1. A structural fuse, comprising:

a first attachment region defining one or more first bolt holes;

a second attachment region defining one or more second bolt holes; and a third attachment region defining one or more third bolt holes;

a yielding region between the first attachment region and the second attachment region, the yielding region defining one or more slots exhibiting an elongated shape, the yielding region configured to be slidably attached to a structural element via the one or more slots; and an additional yielding region between the second attachment region and the third attachment region, the additional yielding region configured to be slidably attached to an additional structural element via one or more additional slots;

wherein the structural fuse is a plate;

wherein the yielding region is between the first attachment region and the third attachment region; and wherein the one or more first bolt holes, the one or more second bolt holes, and the one or more third bolt holes extend through the plate in a direction parallel to each other and perpendicular to a plane in which the plate extends.

2. The structural fuse of claim 1, wherein the first attachment region exhibits a first width, the second attachment region exhibits a second width, and the yielding region exhibits a third width that is less than the first width and the second width.

3. The structural fuse of claim 1, wherein the one or more third bolt holes and the one or more additional slots are aligned in the one or more rows.

4. The structural fuse of claim 1, wherein the one or more first bolt holes, the one or more second bolt holes, and the one or more slots are aligned in one or more rows that extend generally parallel to a longitudinal axis of the structural fuse.

5. A structure, comprising:

a first structural element;

a second structural element spaced from the first structural element by a gap; and at least one structural fuse attaching the first structural element to the second structural element, the structural fuse including:

a first attachment region attached to the first structural element, the first attachment region defining one or more first bolt holes;

a second attachment region attached to the second structural element, the second attachment region defining one or more second bolt holes; and a yielding region between the first attachment region and the second attachment region, the yielding region slidably attached to the second structural element and defining one or more slots, the one or more slots exhibiting an elongated shape, the yielding region attached to the second structural element using one or more bolts extending through the one or more slots; and wherein the at least one structural fuse attaching the first structural element to the second structural element only abuts at least one of a bottom surface of the first structural element or a bottom surface of the second structural element; and wherein the one or more first bolt holes, the one or more second bolt holes, and the one or more slots are aligned with each other in one or more rows that extend generally parallel to a longitudinal axis of the structural fuse, the one or more slots arranged on two or more columns.

6. The structure of claim 5, wherein the first structural element includes a column and the second structural element includes a beam.

7. The structure of claim 5, wherein the first structural element includes a beam and the second structural element includes a link beam.

8. The structure of claim 5, wherein the first structural element includes a wall and the second structural element includes a beam.

9. The structure of claim 5, wherein:

the first structural element includes at least one of a wall or column; and the second structural element includes at least one of a floor or foundation.

10. The structure of claim 5, wherein the first attachment region is attached to the first structural element indirectly using at least one or more plates.

11. The structure of claim 5, further comprising a third structural element; and wherein the at least one structural fuse includes a third attachment region attached to the third structural element and an additional yielding region between the second attachment region and the third attachment region, the additional yielding region slidably attached to the second structural element; and wherein the yielding region is between the first attachment region and the third attachment region.

12. The structure of claim 5, wherein:

the first structural element and the second structural element includes a hollow structural section having four sides; and the at least one structural fuse is attached to one of the four sides of the first structural element and the second structural element.

13. The structure of claim 5, wherein the one or more slots includes a plurality of slots and only at least some of the slots arranged in a plurality of rows and a plurality of columns; and only two or more of the plurality of slots include the one or more bolts extending therethrough, the two or more of the plurality of slots selected to generally uniformly distribute yielding in the yielding region.

14. The structure of claim 5, wherein the first attachment region exhibits a first width, the second attachment region exhibits a second width, and the yielding region exhibits a third width that is less than the first width and the second width.

15. The structure of claim 14, wherein the at least one structural fuse defines a cutout having one or more corners, and wherein the one or more corners are rounded.

16. The structure of claim 5, further comprising one or more straps extending around and slidably attaching the first structural element to the yielding region.

17. The structure of claim 5, wherein the structure does not include an additional plate disposed adjacent to an exterior surface of the structural fuse that is configured to prevent buckling of the structural fuse.

18. The structure of claim 5, wherein the yield region is configured to yield when a tensile load or a compressive load is applied to the at least one structure fuse.

19. The structure of claim 5, wherein the at least one structural fuse only exhibits discrete out-of-plane buckling restraint.

20. The structure of claim 5, wherein the yielding region is directly attached to the second structural element.

21. The structure of claim 5, wherein the one or more first bolt holes, the one or more second bolt holes, and the one or more slots are aligned with each other in one or more rows.

* * * * *